United States Patent [19]

Rudszinat

[11] 4,077,289

[45] Mar. 7, 1978

[54] APPARATUS FOR CONVERTING A RIBBON OF LABELS INTO DISCRETE LABELS

[75] Inventor: Willy Rudszinat, Dassendorf, Germany

[73] Assignee: Hauni Werke Korber & Co., KG, Hamburg, Germany

[21] Appl. No.: 742,888

[22] Filed: Nov. 18, 1976

[51] Int. Cl.[2] ..... B65H 17/40

[52] U.S. Cl. ..... 83/152; 83/159; 83/236; 83/278

[58] Field of Search ..... 83/278, 152, 236, 23, 83/42, 159

[56] References Cited

U.S. PATENT DOCUMENTS

| | | | |
|---|---|---|---|
| 1,009,102 | 11/1911 | Schumann | 83/278 X |
| 1,169,767 | 2/1916 | Bresnan | 83/236 |
| 2,446,305 | 8/1948 | Sandberg | 83/158 X |
| 2,507,395 | 5/1950 | Boegner | 83/278 X |
| 3,213,726 | 10/1965 | Logan et al. | 83/236 X |
| 3,435,717 | 4/1969 | Macomber | 83/278 X |
| 3,973,492 | 8/1976 | Black et al. | 83/278 X |

*Primary Examiner*—Frank T. Yost
*Attorney, Agent, or Firm*—Peter K. Kontler

[57] ABSTRACT

A ribbon consisting of a series of interconnected labels is transported, first continuously and thereupon intermittently, along an elongated path toward a severing station where a movable knife separates successive foremost labels and the separated labels are engaged by pivotable suction heads which move the respective labels sideways into a different path for transport to a packing or other processing machine. That portion of the ribbon path which is located immediately ahead of the severing station extends along an arc of 180°, and the mechanism for intermittently transporting the ribbon has two pivotable deforming jaws which cooperate to deform the ribbon between successive labels whereupon a shoulder of one of the jaws engages the deformed portion and pushes the ribbon toward the severing station. The path for the ribbon includes several additional arcuate portions upstream of the jaws so as to insure that the apparatus can be installed in a small area and that (if necessary) the supply reel which pays out the ribbon can be placed close to the severing station.

10 Claims, 3 Drawing Figures

APPARATUS FOR CONVERTING A RIBBON OF LABELS INTO DISCRETE LABELS

BACKGROUND OF THE INVENTION

The present invention relates to apparatus for cutting labels from a continuous ribbon or strip, and more particularly to improvements in means for guiding and manipulating the ribbon upstream and for guiding and manipulating the labels downstream of the cutting station. Still more particularly, the invention relates to improvements in cutting apparatus of the type disclosed in U.S. Pat. No. 3,435,717 granted Apr. 1, 1969 to Macomber.

The patent to Macomber discloses an apparatus for cutting labels from ribbons which are provided with markers in the form of transverse cuts or slits disposed between neighboring labels. The edges bounding successive transverse cuts are moved to opposite sides of the general plane of the ribbon by a feeding mechanism which advances successive cuts into the range of the knives at the severing station. The path along which the ribbon moves from the supply reel and all the way to the label removing station downstream of the knives is an elongated straight path. This contributes significantly to overall length of the apparatus, especially since the means for removing successive labels also moves in and counter to the direction of lengthwise transport of the ribbon. Therefore, such apparatus cannot be readily installed in many types of existing packing and like processing machines which apply labels to goods, to packages for goods or into such packages. Typical examples of machines which can utilize labels, e.g., in the form of tax stamps, are packing machines for cigarettes or the like. In such machines, space is at a premium because each machine must receive a host of blanks including blanks which consist of metallic foil and are converted into inner envelopes of packs; blanks which consist of paper or cardboard and are converted into outer envelopes of packs; and (at least in certain instances) blanks which are made of transparent synthetic plastic material, which are normally provided with tear strips and which are converted into outermost envelopes of packs. The installation of a relatively long label cutting apparatus in cigarette packing and like machines entails substantial and expensive modifications in design. Such modifications are even costlier if the packing machine forms part of a complete production line including one or more makers (e.g., machines for the production of plain or filter tipped cigarettes) which are directly coupled to the packing machine.

SUMMARY OF THE INVENTION

An object of the invention is to provide a label cutting apparatus which is just as satisfactory as but more compact than heretofore known label cutting apparatus.

Another object of the invention is to provide a label cutting apparatus which can be readily installed in or combined with existing machines for the processing of labels, e.g., with packing machines for smokers' products.

A further object of the invention is to provide the cutting apparatus with novel and improved means for feeding successive labels of a ribbon of labels into the range of severing instrumentalities.

An additional object of the invention is to provide novel and improved means for removing labels from the cutting station.

One feature of the invention resides in the provision of an apparatus for converting a ribbon which consists of a series of coherent labels into discrete labels. The apparatus comprises means for moving the ribbon lengthwise in a predetermined direction from a source of supply (e.g., a reel of convoluted ribbon) along a predetermined elongated path at least one portion of which is arcuate, and means for severing the ribbon at regular intervals in a region downstream of the arcuate portion of the path, as considered in the direction of lengthwise movement of the ribbon, so that the ribbon yields a succession of discrete labels.

The apparatus preferably further comprises means for moving successive discrete labels transversely of the direction of lengthwise movement of the ribbon, for example, along an arcuate path whose center of curvature is located on an axis extending in substantial parallelism with the direction of movement of the ribbon downstream of the arcuate portion of the predetermined path.

The first mentioned moving means preferably comprises (or may comprise) means for moving the ribbon along a predetermined path having several successive arcuate portions including a last arcuate portion which is located immediately upstream of the aforementioned region and constitutes the one arcuate portion. Such configuration of the path renders it possible to locate the source of supply at a distance from the severing station which is only a small fraction of the overall length of the path. The one portion of the path preferably extends along an arc of at least 90°, most preferably along an arc of approximately 180°.

The moving means preferably comprises means for intermittently engaging the ribbon in the arcuate portion of the path and for pushing the ribbon along the arcuate portion toward the region where the ribbon is severed at regular intervals. The moving means may further comprise means for continuously advancing the ribbon in a region ahead of the arcuate portion of the path and for subjecting the ribbon to tension (so as to eliminate slack which would develop as a result of continuous and intermittent movements of different portions of the ribbon) intermediate the loci of continuous and intermittent transport of the ribbon. The means for tensioning the ribbon may comprise a dancer roll or the like.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3:
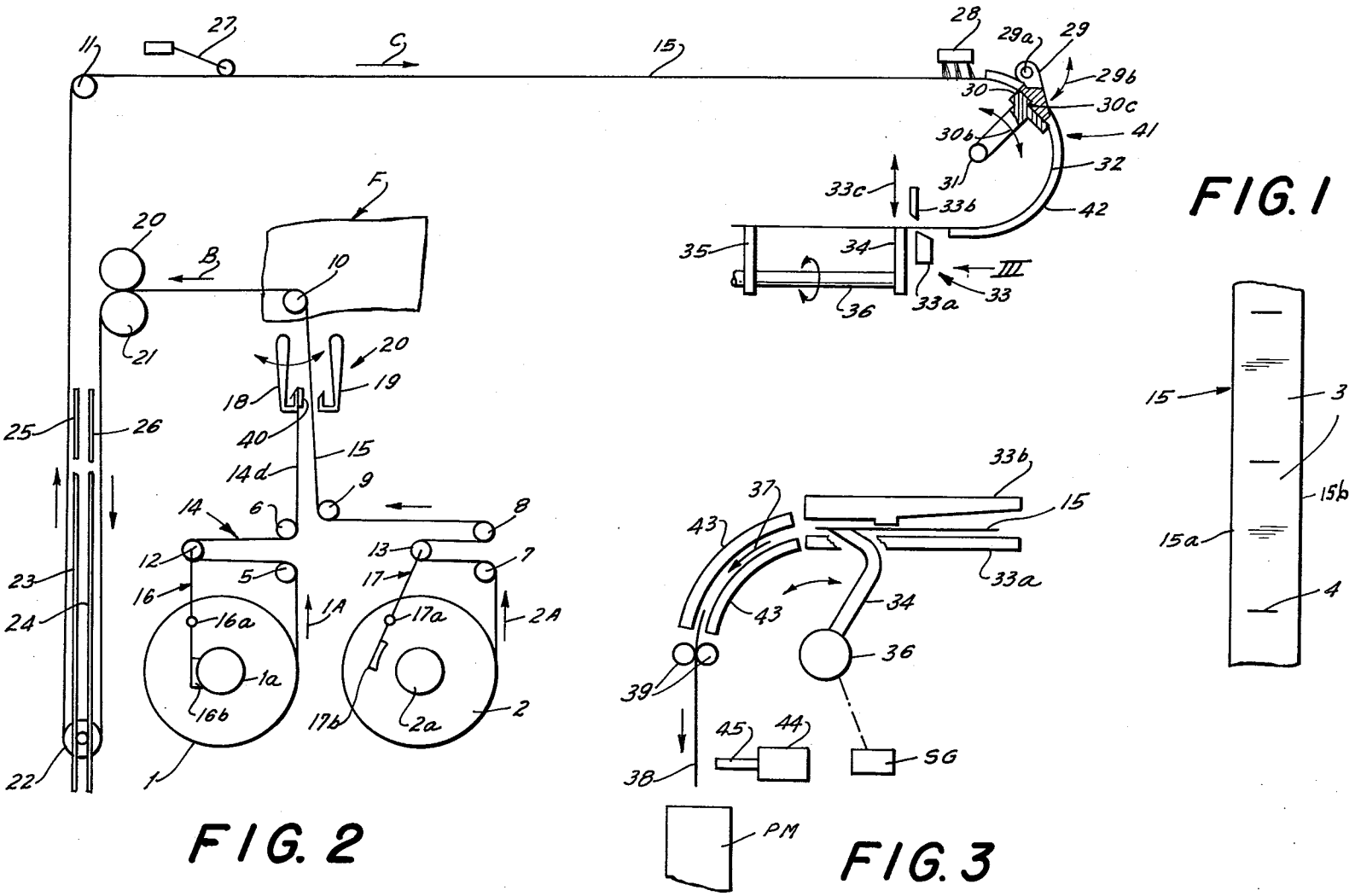
FIG. 1 is a fragmentary plan view of a ribbon of labels which can be processed in the apparatus of the present invention.
FIG. 2 is a fragmentary partly elevational and partly sectional view of the cutting apparatus.
FIG. 3 is a view as seen in the direction of arrow III in FIG. 2.

FIG. 1 shows a portion of a ribbon 15 which consists of a series of coherent or interconnected labels 3. The labels 3 are provided with printed matter or other indicia (not shown); for example, each label 3 may constitute a revenue label or tax stamp of the type used on cigarette packs to seal one end of the outer envelope. The locations where the ribbon 15 is to be severed to yield discrete labels 38 (see FIG. 3) are identified by transverse slits or cuts 4 which are disposed substantially midway intermediate the marginal portions 15*a*, 15*b* of the ribbon and between successive labels 3.

The cutting apparatus of FIG. 2 comprises two spindles 1*a*, 2*a* which respectively support supply reels 1 and 2. The reel 2 consists of convoluted ribbon 15 which is withdrawn to move in the direction indicated by arrow 2A. The ribbon 15 is trained around guide rolls 7, 8, 9, 10 which are mounted in the frame F of the cutting apparatus, and around a tension sensing roll 13 which is connected to one arm of a brake lever 17 fulcrumed at 17*a* and carrying a shoe 17*b* which is disengaged from the spindle 2 while the ribbon 15 is running in the direction indicated by arrow 2A and its tension is within an acceptable range. That portion of the ribbon 15 which advances from the guide roll 9 toward the guide roll 10 moves through a splicing station 20 in the space between two pivotable splicing members 18 and 19.

The fresh reel 1 on the spindle 1*a* consists of a supply of convoluted ribbon 14. The leader 14*d* of the ribbon 14 is trained over guide rolls 5,6 and a tension sensing roll 12 at one end of a brake lever 16 fulcrumed at 16*a* and having a shoe 16*b* which engages the spindle 1 to hold the ribbon 14 against movement in or counter to the direction indicated by arrow 1A. The foremost part of the leader 14*d* of the ribbon 14 is separably attached to the splicing member 18 and carries an adhesive-coated uniting band 40. When the supply of ribbon 15 (reel 2) is nearly exhausted, a detector (e.g., a photoelectric cell or a mechanical sensor which monitors the diameter of the reel 2) transmits a signal which disengages the brake shoe 16*b* from the spindle 1*a* and causes the splicing member 18 to pivot anticlockwise, as viewed in FIG. 2, in order to press the uniting band 40 against the adjacent portion of the running ribbon 15 and to thus form a splice which causes the ribbon 14 to advance with and at the speed of the expiring ribbon 15. At the same time, the splicing member 19 (or a separate device) severs the ribbon 15 behind the splice and the brake shoe 17*b* is caused to engage the spindle 2*a* in order to prevent further unwinding of the remnant of ribbon 15 off the reel 2. The brakes including the levers 16 and 17 are responsive to tension of the respective ribbons and are designed to insure that the tension remains within a predetermined range.

The ribbon 15 passes through the nip of two continuously driven advancing rolls 20, 21 which transport the ribbon in the direction indicated by arrow B toward and around a dancer roll 22 which is movable up and down between two pairs of upright guide rails 23, 25 and 24, 26. The dancer roll 22 serves to tension the ribbon 15, i.e., to compensate for deviations of the rate of intermittent transport or feeding of ribbon downstream of the continuously driven rolls 20, 21 from the rate at which the rolls 20, 21 advance the ribbon toward the dancer roll 22.

The ribbon 15 thereupon passes around a further guide roll 11 and past a suitable sensor 27 which serves as a means for detecting splices (formed by uniting bands 40), e.g., in order to arrest the ribbon feeding mechanism 41 with a certain delay and to thus allow for removal of a label 38 which carries the splice from the path wherein discrete labels are fed to the corresponding station of a packing or other processing machine PM (FIG. 3).

A brush 28 immediately upstream of the feeding mechanism 41 constitutes a simple brake which prevents the ribbon 15 from moving backwards, i.e., counter to the direction indicated by arrow C. Those increments of the ribbon 15 which advance beyond the brush 28 move along an arcuate portion 32 of the ribbon path, i.e., along the concave side of a guide member or shroud 42, and into the range of two deforming jaws 29, 30 of the feeding mechanism 41. In accordance with a feature of the invention, the jaws 29 and 30 are pivotable, rather than reciprocable, and the jaw 30 cooperates with the shroud 42 to change the direction of movement of the ribbon 15, preferably by at least 90° and most preferably by 180°, so that the ribbon moves counter to the direction indicated by arrow C when it approaches the cutting station. The jaw 29 is pivotable on or with a shaft 29*a* in directions indicated by a double-headed arrow 29*b*, and the jaw 30 is pivotable about the axis of a shaft 31 in directions indicated by a double-headed arrow 30*b*. The shafts 29*a*, 31 can constitute component parts of the means for pivoting the respective jaws. The manner in which tha jaws 29 and 30 cooperate to deform the ribbon 15 in the regions of successive transverse cuts 4 is the same as or analogous to that disclosed in the patent to Macomber. It suffices to say that the shoulder 30*c* of the jaw 30 entrains the adjacent edge face at the front side of the respective cut 4 and pushes the ribbon 15 toward the cutting station while moving clockwise, as viewed in FIG. 2. The jaw 29 is pivoted anticlockwise before the jaw 30 begins to pivot clockwise so that the jaw 29 does not interfere with forward transport of the ribbon 15 toward the cutting station. When the jaw 30 moves backwards (i.e., anticlockwise, as viewed in FIG. 2), the bristles of the brush 28 prevent the ribbon 15 from moving counter to the direction indicated by arrow C.

The knife 33 comprises two blades 33*a*, 33*b* the first of which is stationary and the second of which is movable across the path of the ribbon 15 to sever the latter in the plane including the respective transverse cut 4. The movements of blade 33*b* are synchronized with movements of the jaw 30 so that the blade 33*b* severs the ribbon 15 upon completion of clockwise pivotal movement of the jaw 30. The directions in which the blade 33*b* is movable across the path of the ribbon 15 are indicated by a double-headed arrow 33*c*. The manner in which the movements of the blade 33*b* are synchronized with movements of the jaw 30 to insure that the knife 33 invariably severs the ribbon 15 in the planes of successive transverse cuts 4 is the same as or analogous to that disclosed in the patent to Macomber to which reference may be had, if necessary.

The knife 33 is followed by a removing mechanism which includes two transfer members here shown as suction heads 34, 35 pivotable about the axis of a shaft 36 which is parallel to the direction of lengthwise movement of the leader of the ribbon 15 through the severing station. The shaft 36 pivots the suction heads 34, 35 anticlockwise, as viewed in FIG. 3, when the blade 33*b* completes a severing stroke so as to transport the freshly separated label 38 sideways through a channel 43 and into the nip of two advancing rolls 39 which transport the label to the corresponding station of the processing machine PM (e.g., a packing machine for filter cigarettes). The manner in which the suction heads 34, 35 are connected with a suction generating device SG during pivotal movement in a counterclockwise direction (preferably by way of passages in their arms and in the shaft 36) is well known from the art and is not shown in the drawing. It suffices to say that the heads 34, 35 attract the freshly separated label 38 while moving anticlockwise. The channel 43 has suitable slots for the arms of the suction heads 34, 35 so that the label 38 can advance in the direction indicated by arrow 37. The suction heads 34, 35 return to the positions shown in FIG. 3 not later than when the blade **33*b*** completes the next cutting stroke.

If desired, the signal from the sensor 27 can be used to energize an electromagnet 44 which moves its armature 45 against the label 38 upstream or downstream of the advancing rolls 39 to direct the label which carries a splice into an intercepting receptacle, not shown.

The term "ribbon" is intended to denote any type of elongated web, tape or strip which may consist of paper, synthetic plastic material, cardboard, metallic foil or a combination of such substances and is to be subdivided into sections each of which may constitute a label. The term "label" denotes a preferably square or rectangular piece of ribbon which may but need not bear printed matter, which may but need not be coated with adhesive, which may but need not exhibit two or more colors, and which may be used as a means for sealing packs or other containers, as a coupon for insertion into containers, as a ring around cigars or other smokers' products, as a detachable insert forming part of the inner envelope (metallic foil) of a pack for cigarettes or the like, as a reinforcing insert in a so-called flip-top pack for cigarettes or the like, as a price tag, as a means for receiving information to be applied thereto by hand or by automatic encoding means, and/or for other related or unrelated purposes.

An important advantage of the cutting apparatus which is shown in FIGS. 2 and 3 is that its space requirements are only a fraction of the space requirements of apparatus which is disclosed in the patent to Macomber. This is due to the fact that the jaw 30 is movable along an arcuate path and cooperates with the shroud 42 to change the direction of movement of the ribbon 15 immediately upstream of the cutting station (knife 33). The provision of suction heads 34, 35 (these can be replaced by mechanical grippers or other suitable transfer members) also contributes to compactness of the cutting apparatus because the suction heads move the labels 38 sideways rather than in the direction of lengthwise movement of the ribbon 15. Additional savings in space are achieved by the provision of guide rolls for the ribbons 14, 15 and the dancer roll 22; these parts are designed to repeatedly change the direction of movement of the ribbon from the respective supply reel to the feeding mechanism 41 so as to insure an optimum utilization of the space which is available in existing processing machines. Therefore, the improved apparatus can be installed in or combined with existing processing machines without any or with minimal modifications of such machines. This is especially important in tobacco processing plants wherein entire batteries consisting of dozens or hundreds of packing and other machines are set up, either separately or as component parts of production lines. In such plants, the installation of an improved apparatus (e.g., the aforedescribed cutting apparatus), without any or with minimal alterations of the production lines, contributes significantly to savings in cost, labor and output.

Without further analysis, the foregoing will so fully reveal the gist of the present invention that others can, by applying current knowledge, readily adapt it for various applications without omitting featurs that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. Apparatus for converting a ribbon consisting of a series of coherent labels into discrete labels, comprising a source of ribbon; means for moving the ribbon from said source lengthwise in a predetermined direction; guide means defining for the ribbon an elongated path including at least one arcuate portion; and means for severing the ribbon at regular intervals downstream of said arcuate portion, as considered in said direction, so that the ribbon yields a succession of discrete labels, said moving means including a first pivotable ribbon deforming member at one side of said arcuate portion of said path, a second ribbon deforming member located opposite said first deforming member at the other side of said arcuate portion, means for intermittently moving said second deforming member toward said first deforming member to thereby deform the ribbon portion between said members, and means for pivoting said first deforming member along said arcuate portion in and counter to said direction, said first deforming member having means for pushing the deformed portion of the ribbon toward said severing means during movement of said first deforming member in said direction.

2. Apparatus as defined in claim 1, further comprising transfer means for moving successive discrete labels from said path in a second direction other than said first mentioned direction.

3. Apparatus as defined in claim 2, wherein said transfer means includes at least one transfer member pivotable about an axis which is at least substantially parallel to said direction in the region of said severing means.

4. Apparatus as defined in claim 1, wherein said guide means includes means which defines for the ribbon a path having several arcuate portions including a last arcuate portion, as considered in said direction, said last arcuate portion constituting said one arcuate portion.

5. Apparatus as defined in claim 1, wherein said one portion of said path extends along an arc of at least 90°.

6. Apparatus as defined in claim 1, further comprising means for preventing the ribbon from moving with said first deforming member during movement of said first deforming member counter to said direction.

7. Apparatus as defined in claim 1, wherein said portion of said path has a concave and a convex side and said first deforming member is adjacent said concave side.

8. Apparatus as defined in claim 1, wherein said moving means further comprises means for continuously advancing the ribbon ahead of said arcuate portion.

9. Apparatus as defined in claim 8, further comprising means for tensioning the ribbon intermediate said advancing means and said deforming members.

10. Apparatus as defined in claim 1, wherein the distance between said source and said severing means is a small fraction of the length of said path.

* * * * *